US008191179B2

(12) United States Patent
Durocher et al.

(10) Patent No.: US 8,191,179 B2
(45) Date of Patent: Jun. 5, 2012

(54) HOCKEY HELMET WITH AN OUTER SHELL MADE OF TWO DIFFERENT MATERIALS

(75) Inventors: Jacques Durocher, Saint-Jérôme (CA); Jean-François Laperrière, Prévost (CA); Marie-Claude Généreux, Sainte-Thérèse (CA); Denis Côté, Saint-Colomban (CA); Sébastien Lambert, Sainte-Sophie (CA)

(73) Assignee: Bauer Hockey, Inc., Greenland, NH (US)

( * ) Notice: Subject to any disclaimer, the term of this patent is extended or adjusted under 35 U.S.C. 154(b) by 1021 days.

(21) Appl. No.: 12/020,057

(22) Filed: Jan. 25, 2008

(65) Prior Publication Data

US 2009/0188022 A1 Jul. 30, 2009

(51) Int. Cl.
*A63B 71/10* (2006.01)

(52) U.S. Cl. ..... 2/425; 2/410; 2/411; 2/412; 2/420

(58) Field of Classification Search ..... 2/455, 410, 2/425, 411, 412, 414, 417, 420
See application file for complete search history.

(56) References Cited

U.S. PATENT DOCUMENTS

| | | | | | |
|---|---|---|---|---|---|
| 4,404,690 | A * | 9/1983 | Farquharson | ..... | 2/420 |
| RE34,699 | E * | 8/1994 | Copeland et al. | ..... | 2/419 |
| 5,950,244 | A * | 9/1999 | Fournier et al. | ..... | 2/414 |
| 6,108,824 | A * | 8/2000 | Fournier et al. | ..... | 2/418 |
| 6,292,952 | B1 * | 9/2001 | Watters et al. | ..... | 2/411 |
| 6,298,497 | B1 * | 10/2001 | Chartrand | ..... | 2/414 |
| 6,389,607 | B1 * | 5/2002 | Wood | ..... | 2/425 |
| 6,446,270 | B1 * | 9/2002 | Durr | ..... | 2/412 |
| 6,490,730 | B1 * | 12/2002 | Lyden | ..... | 2/22 |
| 6,865,752 | B2 * | 3/2005 | Udelhofen et al. | ..... | 2/425 |
| 6,883,183 | B2 * | 4/2005 | Morrow et al. | ..... | 2/425 |
| 6,968,575 | B2 * | 11/2005 | Durocher | ..... | 2/425 |
| 7,260,854 | B2 * | 8/2007 | Hahn et al. | ..... | 2/431 |
| 7,673,351 | B2 * | 3/2010 | Copeland et al. | ..... | 2/425 |
| 7,908,678 | B2 * | 3/2011 | Brine et al. | ..... | 2/417 |
| 2003/0135914 | A1 * | 7/2003 | Racine et al. | ..... | 2/413 |
| 2008/0086795 | A1 * | 4/2008 | Cyr et al. | ..... | 2/425 |
| 2009/0106882 | A1 * | 4/2009 | Nimmons et al. | ..... | 2/414 |

* cited by examiner

*Primary Examiner* — Christopher Harmon

(57) ABSTRACT

The present invention covers a hockey helmet for receiving a head of a player. The helmet comprises an outer shell made of first and second materials having respective first and second flexibilities. The outer shell comprises a front portion for at least partially facing the crown region of the head, a top portion for at least partially facing the top region of the head, a back portion for at least partially facing the back region of the head, an occipital portion for at least partially facing the occipital region of the head, and left and right portions for at least partially facing the left and right side regions of the head, the left and right portions comprising respective left and right projections that extend downwardly in front of the respective left and right ears and left and right sections located above and behind the respective left and right ears wherein one of the occipital portion, left and right projections and left and right sections is made of the second material and wherein the second flexibility is greater from the first flexibility.

49 Claims, 7 Drawing Sheets

HOCKEY HELMET WITH AN OUTER SHELL MADE OF TWO DIFFERENT MATERIALS

FIELD OF THE INVENTION

The present invention relates to a hockey helmet having an outer shell made of two different materials.

BACKGROUND OF THE INVENTION

Hockey helmets that are commercialized today generally have outer shells that are made of solid plastic. Generally, the plastic outer shell extends all the way to the edges of the helmet and may contacts with the head of the player, despite the presence of an inner liner. Even if the shell is designed so as to not touch the head, it may still come into contact with a portion of the head of the player when the helmet shifts during an impact. As a result, in case of an impact, the outer shell can press against a portion of the head and cause injury, for example by cutting such portion of the head.

It can therefore be appreciated that there is a need in the industry for a hockey helmet that is more comfortable to wear, that has a reduced risk of cutting or otherwise injuring the player.

SUMMARY OF THE INVENTION

As embodied and broadly described herein, the present invention covers a hockey helmet for receiving a head of a player. The head has a crown region (CR) left and right side regions (LS, RS), a top region (TR), left and right ears (LE, RE), a back region (BR) and an occipital region (OC). The helmet comprises an outer shell made of first and second materials having respective first and second flexibilities. The outer shell comprises a front portion for at least partially facing the crown region (CR) of the head, a top portion for at least partially facing the top region (TR) of the head, a back portion for at least partially facing the back region (BR) of the head, an occipital portion for at least partially facing the occipital region (OC) of the head, and left and right portions for at least partially facing the left and right side regions (LS, RS) of the head, the left and right portions comprising respective left and right projections that extend downwardly in front of the respective left and right ears (LE, RE) and left and right sections located above and behind the respective left and right ears (LE, RE); wherein one of the occipital portion, left and right projections and left and right sections is made of the second material and wherein the second flexibility is greater from the first flexibility.

The invention also provides a hockey helmet comprising an outer shell made of first and second materials having respective first and second flexibilities. The outer shell comprises (a) a front portion for at least partially facing the crown region (CR) of the head; (b) a top portion for at least partially facing the top region (TR) of the head; (c) a back portion for at least partially facing the back region (BR) of the head; (d) an occipital portion for at least partially facing the occipital region (OC) of the head; and (c) left and right portions for at least partially facing the left and right side regions (LS, RS) of the head, the left and right portions comprising respective left and right projections extending downwardly in front of the respective left and right ears (LE, RE) and left and right sections located above and behind the respective left and right ears (LE, RE); wherein one of the occipital portion, left and right projections and left and right sections is partially made of the second material and wherein the second flexibility is greater from the first flexibility.

The invention further provides a hockey helmet comprising an outer shell made of first and second materials having respective first and second flexibilities, the outer shell comprising: (a) a front portion for at least partially facing the crown region (CR) of the head, the front portion having a front edge portion; (b) a top portion for at least partially facing the top region (TR) of the head; (c) a back portion for at least partially facing the back region (BR) of the head; (d) an occipital portion for at least partially facing the occipital region (OC) of the head, the occipital portion having a rear edge portion; and (e) left and right portions for at least partially facing the left and right side regions (LS, RS) of the head, the left and right portions comprising respective left and right projections extending downwardly in front of the respective left and right ears (LE, RE) and left and right sections located above and behind the respective left and right ears (LE, RE), the left and right sections having respective left and right edge portions; wherein one of the front edge portion, rear edge portion, left and right projections and left and right edge portions is partially made of the second material and wherein the second flexibility is greater from the first flexibility.

BRIEF DESCRIPTION OF THE DRAWINGS

A detailed description of the embodiments of the present invention is provided herein below, by way of example only, with reference to the accompanying drawings, in which.

Figure 1:
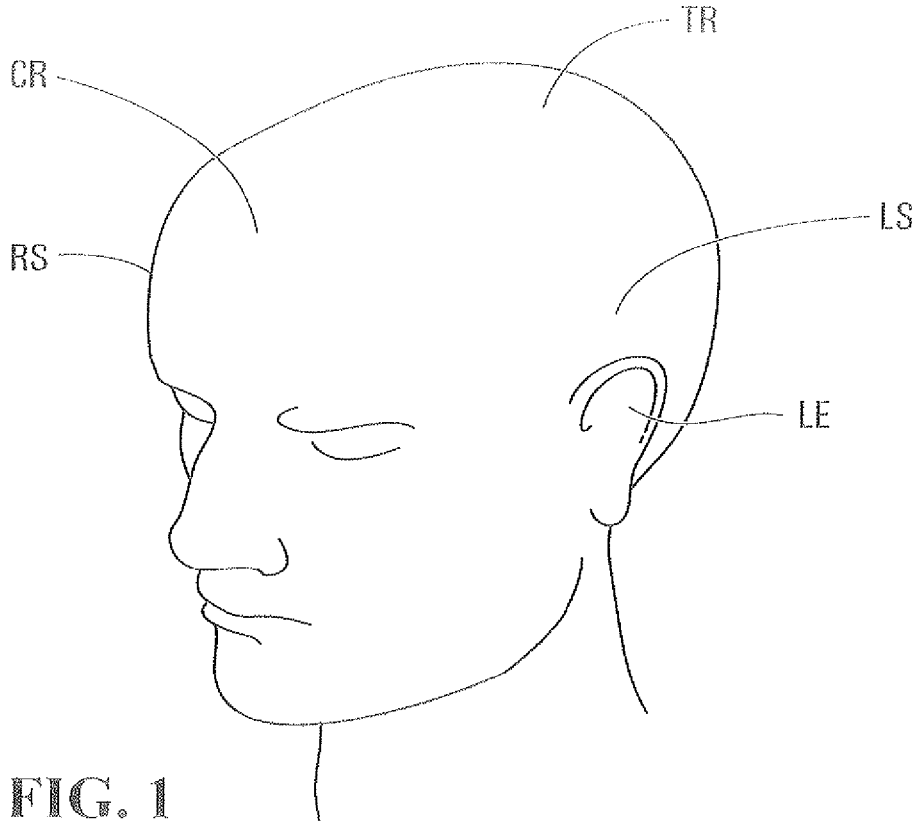
FIG. 1 is a perspective view of a head of a player.

In the drawings, embodiments of the invention are illustrated by way of examples. It is to be expressly understood that the description and drawings are only for the purpose of illustration and are an aid for understanding. They are not intended to be a definition of the limits of the invention.

DETAILED DESCRIPTION OF THE EMBODIMENTS OF THE INVENTION

It should be clearly understood that like reference numerals are intended to identify the same structural elements, parts, portions or surfaces consistently throughout the several drawing figures, as such elements, parts, portions or surfaces may be further described or explained by the entire written specifications, of which this detailed description is an integral part. In describing the embodiments, specific terminology is resorted to for the sake of clarity but the invention is not intended to be limited to the specific terms so selected, and it is understood that each specific term comprises all equivalents.

Figure 2:
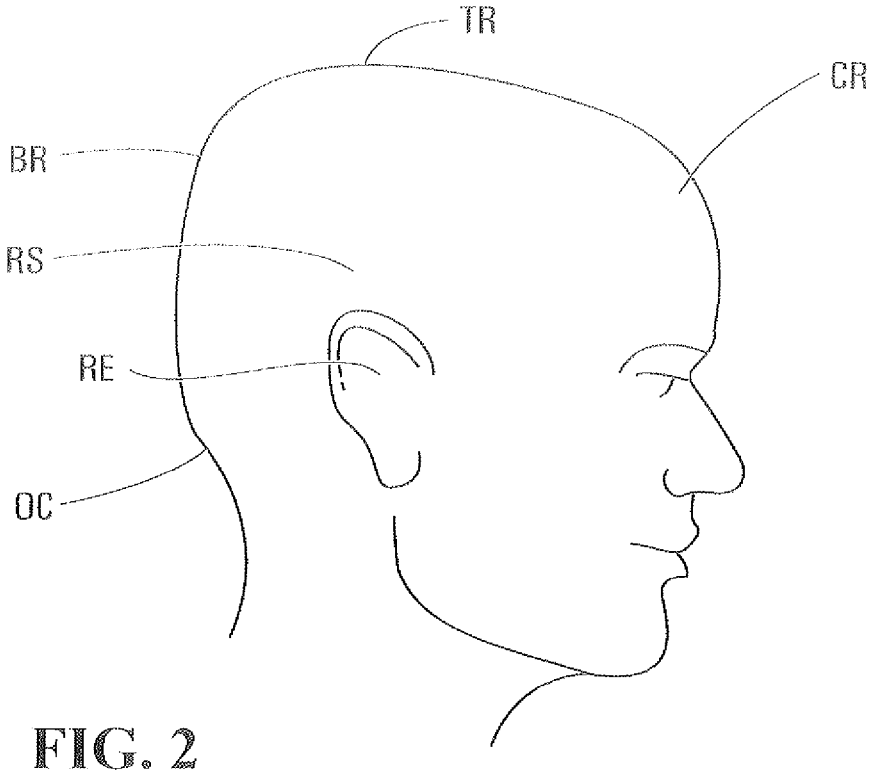
FIG. 2 is a right side elevational view of the head of the player of FIG. 1.
Figure 3:
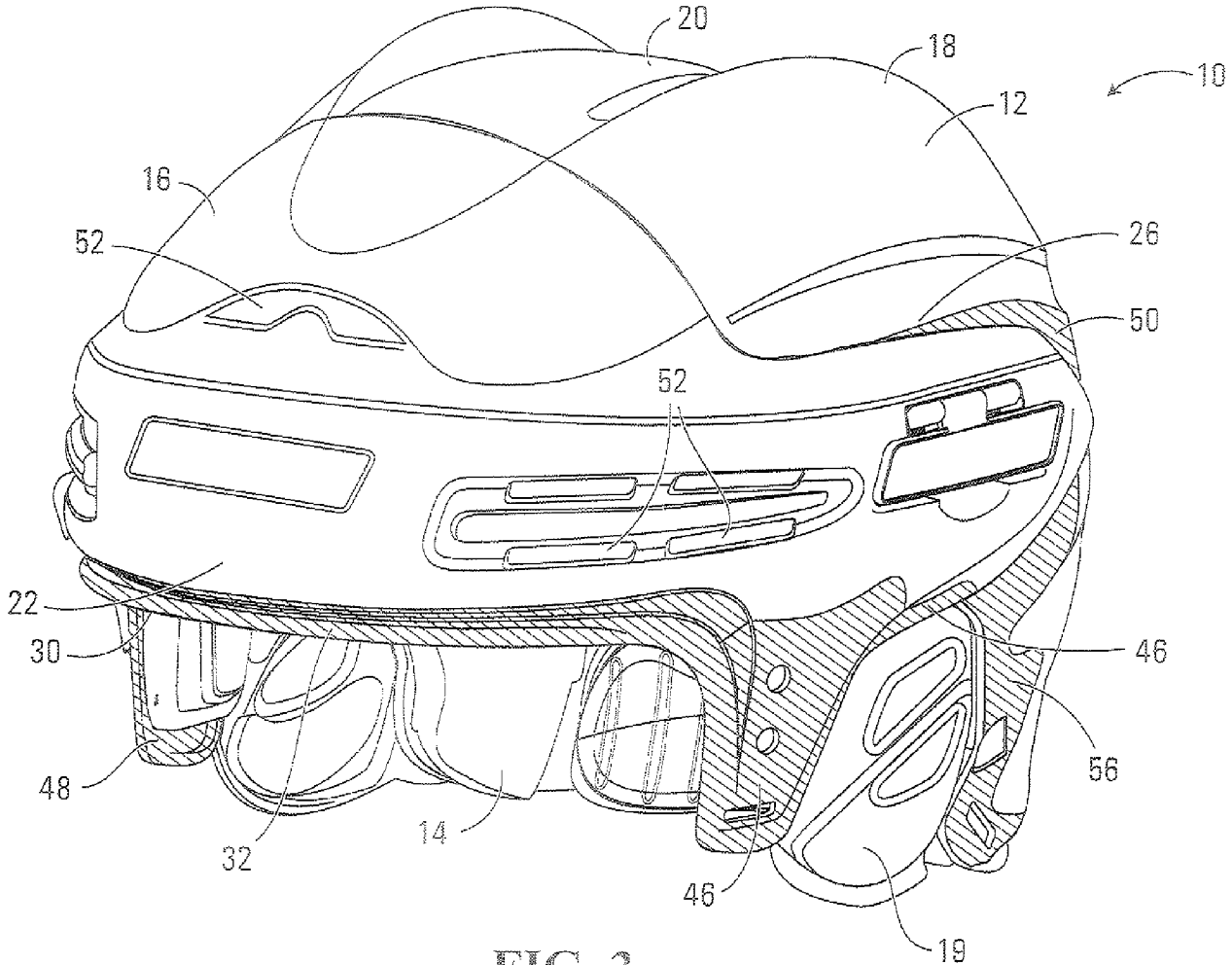
FIG. 3 is a perspective view of a hockey helmet constructed in accordance with an embodiment of the invention.

FIGS. 1 and 2 illustrate a head of a player. The head comprises a crown region CR, left and right side regions LS, RS, a back region BR, a top region TR and an occipital region OC. The crown region CR has a front part that substantially corresponds to the forehead and a top part that substantially corresponds to the front top part of the head. In fact, the crown region CR generally corresponds to the frontal bone region of the head. The left and right side regions LS, RS are approximately located above the left and right ears LE, RE of the player. The top region substantially corresponds to the top of the head. Occipital region OC substantially corresponds to the region around and under the external occipital protuberance of the head.

Referring to FIGS. 3 to 8, a hockey helmet 10 constructed in accordance with the present invention is shown. The helmet 10 comprises an outer shell 12 and an inner protective liner 14 as well as optional comfort liners. For example, the inner layer 14 may comprise a front inner pad, a top inner pad, a rear inner pad and left and right inner pads, each facing their respective regions of the head. The inner pads have three-dimensional configurations that match the three-dimensional configurations of the outer shell 12 and are attached to the inner surfaces of the outer shell 12 by any suitable means (e.g. glue). The inner pads may be made of shock absorbing materials such as expanded polypropylene (EPP) or expanded polyethylene (EPE). Other materials can also be used without departing from the spirit of the invention.

The outer shell 12 optionally comprises a front shell 16 and a rear shell 18, which can move one with relation to the other so as to adjust the size of the head receiving cavity of the helmet 10. Left and right locking mechanisms may retain the front and rear shells 16, 18 in the position selected by the player. Any suitable type of locking mechanisms such as the one described in U.S. Pat. No. 5,956,776 or U.S. Pat. No. 6,966,075 of Bauer Nike Hockey Inc. issued on Sep. 28, 1999 can be used without departing from the spirit of the invention. In this non-limiting example, a player who puts on the helmet 10 and realizes that it is too large or too small, does not need to remove the helmet 10 to adjust it. The player must simply release the locking mechanisms and expand or contract the size of the helmet 10 by displacing the front and the rear shells 16, 18 of the helmet in relation to each other in the appropriate direction.

Alternatively, helmet 10 may comprise a non-adjustable one-piece shell covering a one-piece inner pad and a one-piece comfort liner. In another possible variant, the helmet 10 may comprise separate front and rear shells connected to one another in any suitable way but not adjustable one relative to the other.

Figure 4:
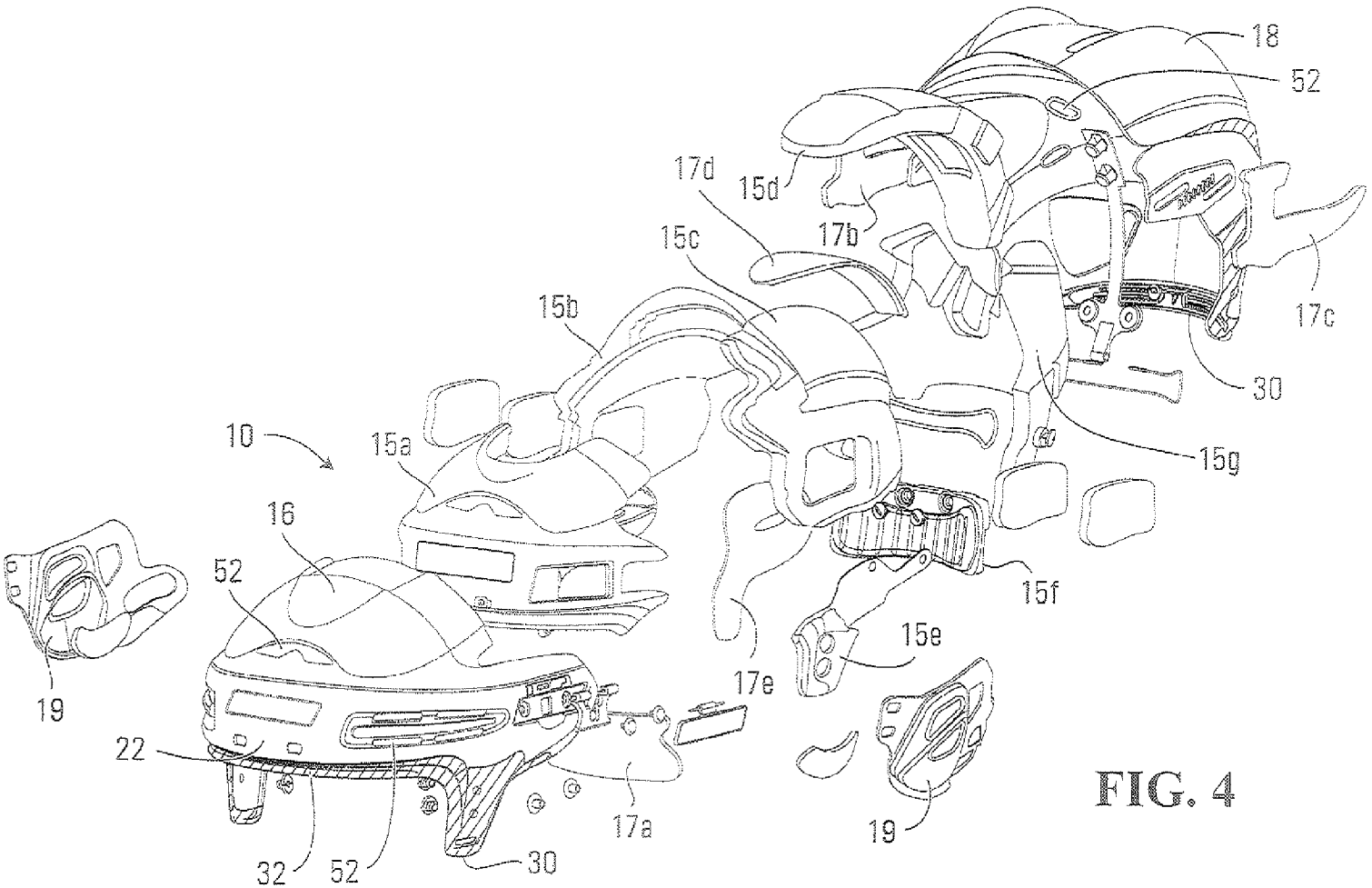
FIG. 4 is an exploded view of the helmet of FIG. 3.
Figure 5:
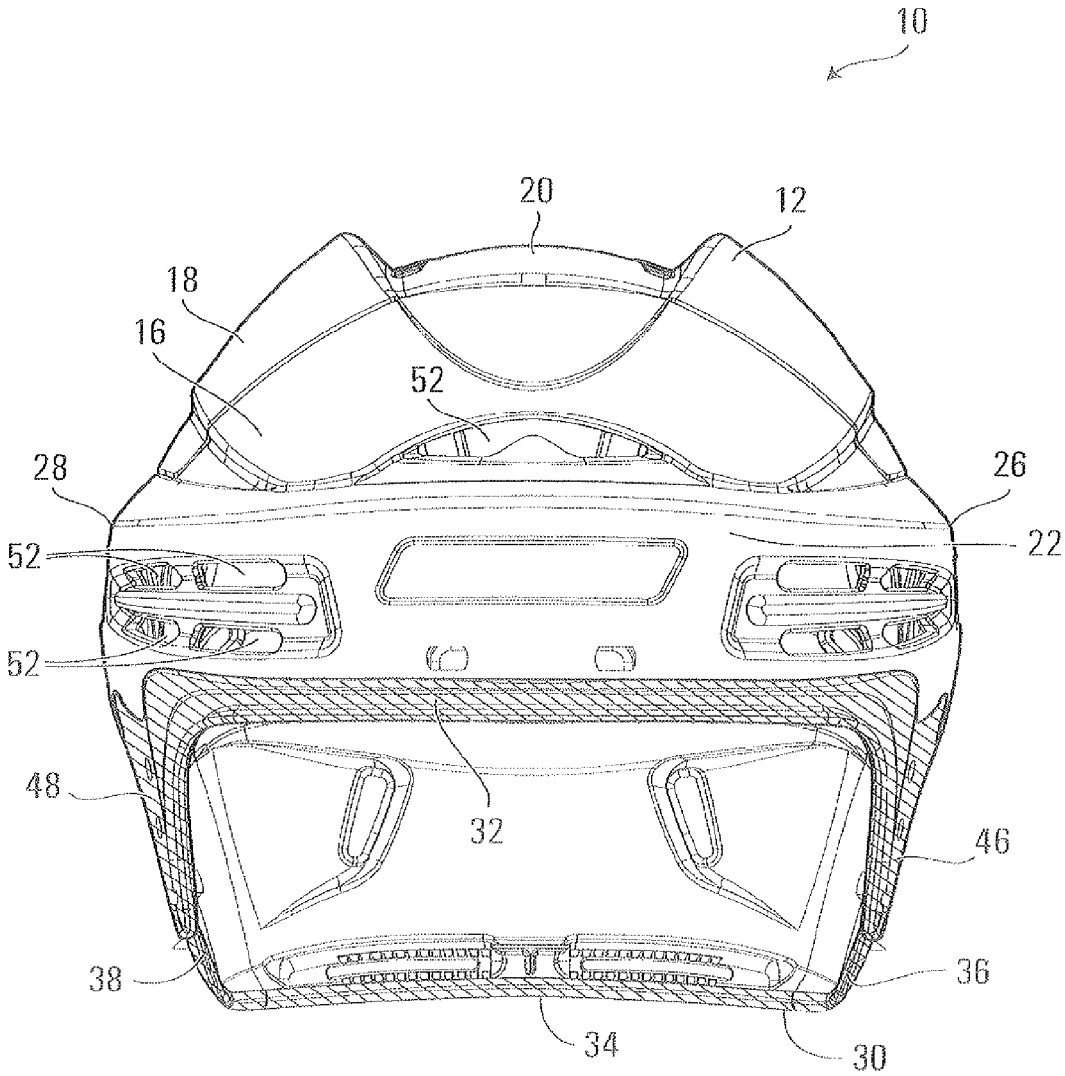
FIG. 5 is a front elevation view of the hockey helmet of FIG. 3.
Figure 6:
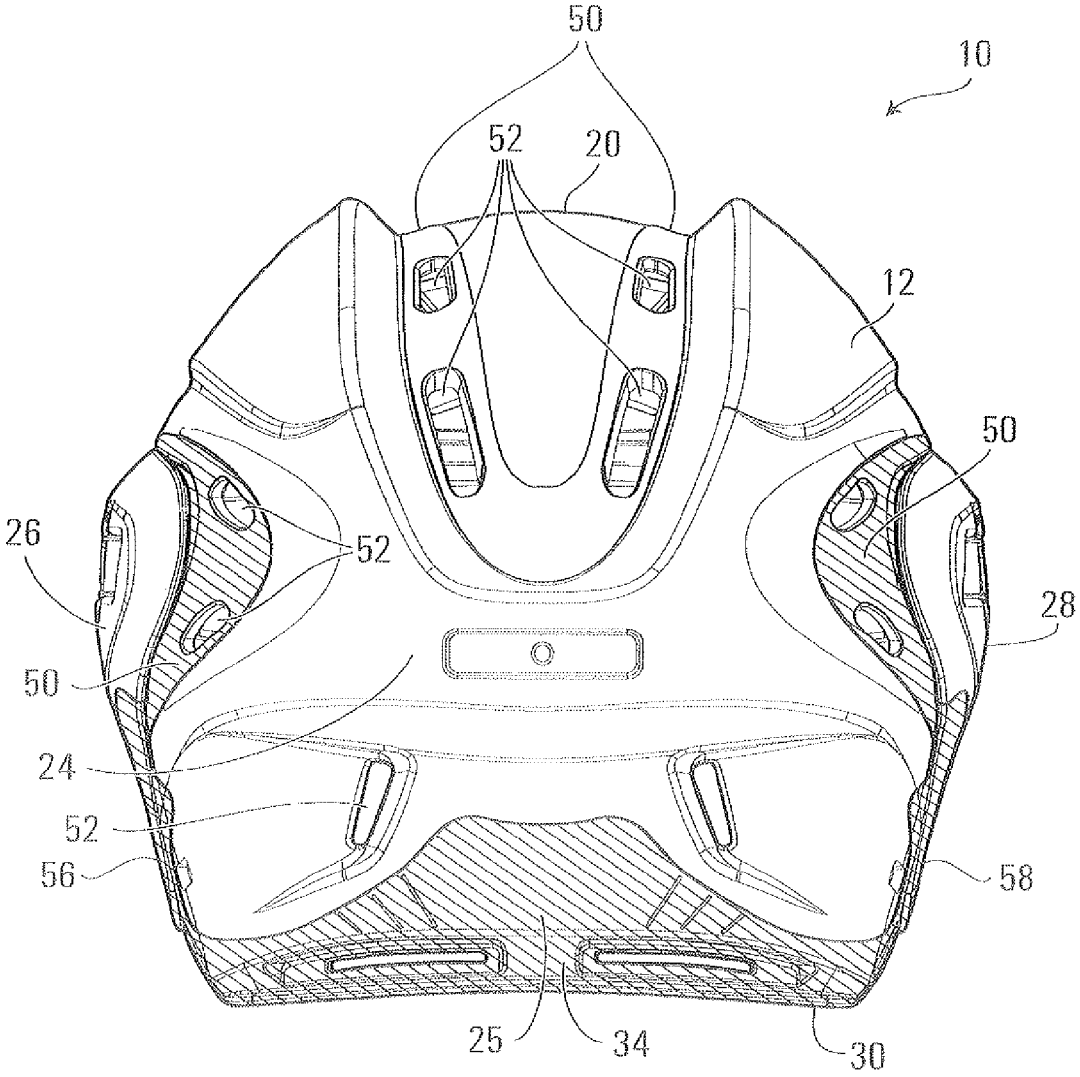
FIG. 6 a rear elevation view of the hockey helmet of FIG. 3.
Figure 7:
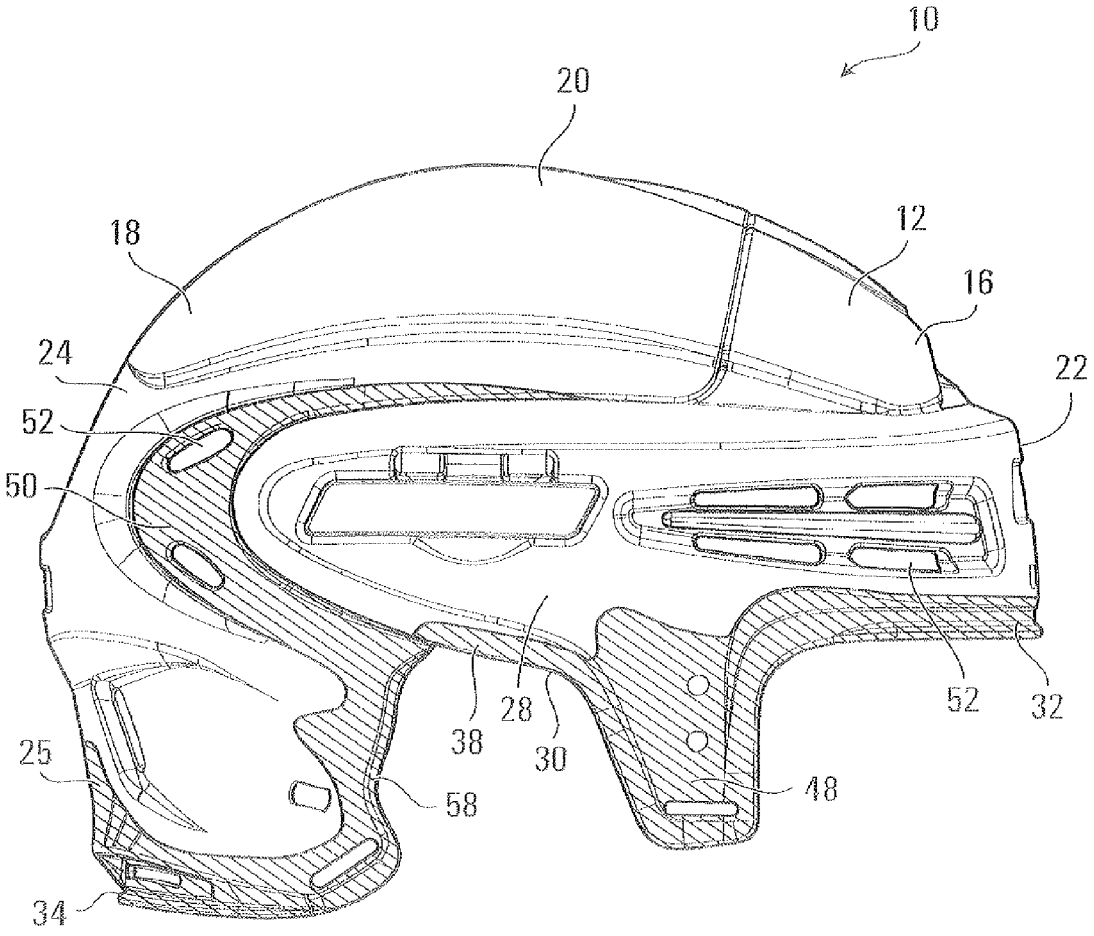
FIG. 7 is a right side elevation view of the hockey helmet of FIG. 3.
Figure 8:
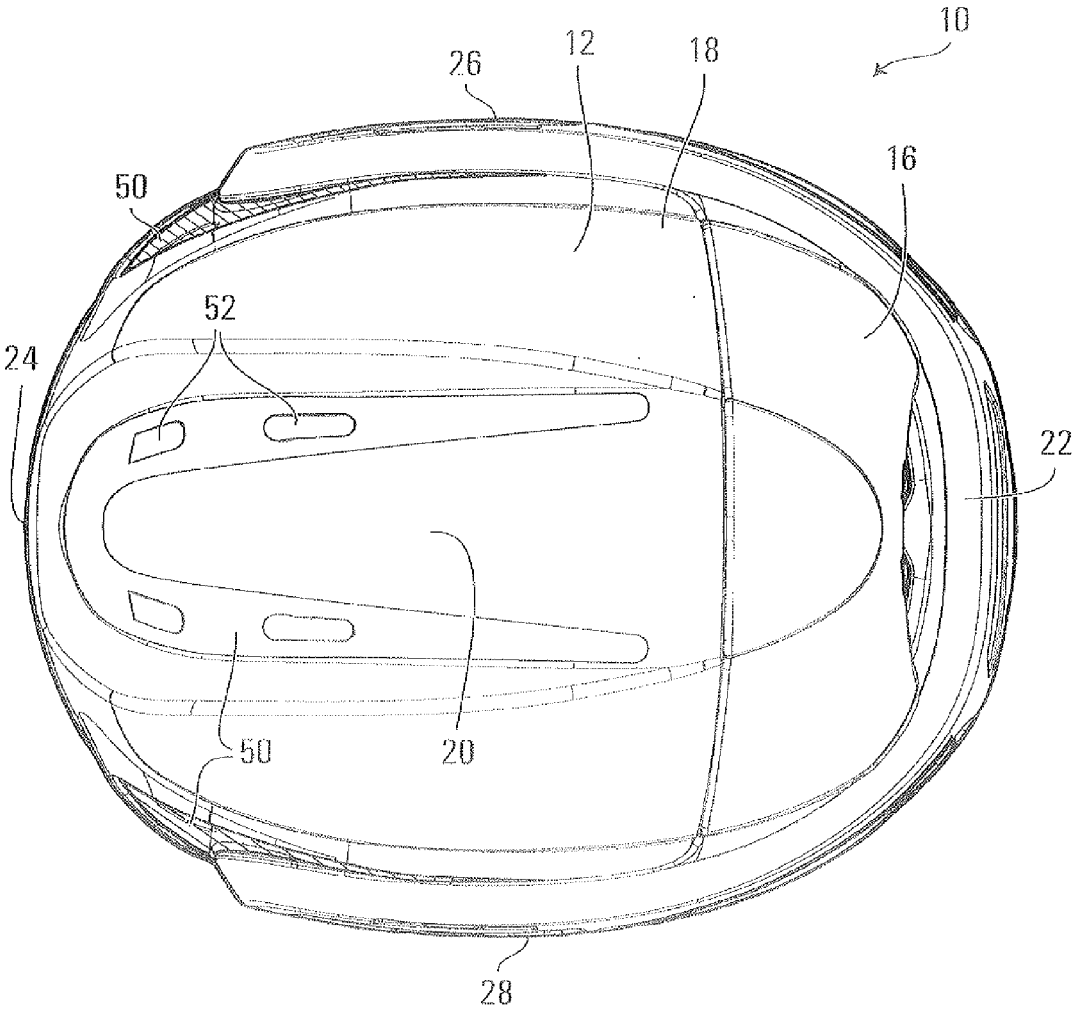
FIG. 8 is a top plan view of the hockey helmet of FIG. 3.

As shown in FIG. 4, the helmet 10 has a plurality of inner pads 15*a*-15*e*. The front shell 16 overlays front inner pad 15*a* and temple inner pads 15*e* (only one visible here) while the rear shell 18 overlays rear central inner pad 15*d* and right and left side inner pads 15*b*, 15*c*. The right and left side inner pads 15*b*, 15*c* at least partially cover the right and left side inner surfaces of the rear shell 18. The front inner pad 15*a* faces the crown region CR. A rear inner pad 15*g* faces the back region BR while a central top inner pad 15*d* faces the top region TR and while the right and left side inner pads 15*b*, 15*c* face the respective left and right side regions LS, RS. The helmet 10 further comprises an occipital pad 15*f* for facing the occipital region OC of the head. The inner pads 15*a*, 15*b*, 15*c*, 15*d*, 15*e*, 15*f* may be made of shock absorbing materials such as expanded polypropylene (EPP) or expanded polyethylene (EPE). Other materials can also be used without departing from the spirit of the invention.

The front inner pad 15*a* and temple inner pads 15*e* have three-dimensional configurations that match the three-dimensional configurations of the front shell 16 and are attached to the inner surfaces of the front shell 16 by any suitable means such glue, stitches, tacks, staples or rivets. Similarly, rear central inner pad 15*d* and right and left side inner pads 15*b*, 15*c* have three-dimensional configurations that match the three-dimensional configurations of the rear shells 18 and are attached to respective inner surfaces of the rear shells 18 by any suitable means, such as glue, stitches, tacks, staples or rivets.

The helmet 10 also comprises a front comfort liner 17*a* affixed on the inner surface of the front inner pad 15*a*, right and left side comfort liners 17*b*, 17*c*, affixed on the inner surface of the respective right and left side inner pads 15*b*, 15*c*, a central rear comfort liner 17*d* affixed on the inner surface of the top inner pad 15*d* and temple comfort liners 17*e* affixed on the inner surface of the respective temple inner pads 15*e*. The comfort liners 17*a*, 17*b*, 17*c*, 17*d*, 17*e* may be made of soft materials such as polyvinyl chloride (PVC). Other materials can also be used without departing from the spirit of the invention. The comfort liners 17*a*, 17*b*, 17*c*, 17*d*, 17*e* may be affixed on the inner surface of the respective inner pads 15*a*, 15*b*, 15*c*, 15*d*, 15*e* by any suitable means, such as glue, stitches, tacks, staples or rivets.

The hockey helmet 10 may comprise left and right ear loops and a chin strap adapted to be attached to ear loops so that when it is secured beneath the chin of the player, the helmet 10 is maintained onto the head of the player. If desired, the helmet 10 may be provided with left and right ear covers 19 for protecting the ears of the player.

It is to be understood that any configuration of the inner pads and comfort liners may be used, the arrangement shown here being only an exemplary one. For example, the helmet 10 may comprise a single unitary inner pad and a single unitary comfort liner or any other number of inner pads and comfort liners of any suitable dimensions.

The helmet 10 may comprise a plurality of ventilation apertures 52 that provide the added comfort of allowing air to circulate around the head of the player.

Referring to FIGS. 5 to 8, the outer shell 12 comprises a top portion 20, a front portion 22, a rear portion 24, an occipital portion 25, a left portion 26 and a right portion 28. The top portion 20 is adapted to face at least partially the top region TR of the head. The front portion 22 is adapted to face at least partially the crown region CR of the head. The rear portion 24 is adapted to face at least partially the back region BR of the head. The occipital portion 25 is adapted to face at least partially the occipital region OC of the head. The left and right portions 26, 28 are adapted to face at least partially the respective left and right side regions LS, RS of the head. As shown in FIGS. 3 to 8, the shell 12 has front and rear shells 16, 18. In this case, left and right portions 26, 28 each span both the front and rear shells 16, 18. But of course, it is understood that the helmet 10 may comprise a one-piece shell instead of a two piece shell.

At the periphery of the outer shell 12, there is an edge 30, which roughly surrounds the bottom of the helmet and is defined by a front edge portion 32, a rear edge portion 34, a left side edge portion 36 and a right side edge portion 38. The left and right portions 26, 28 of the outer shell 12 comprise respective left and right projections 46, 48 projecting downwardly in front of respective left and right ears LE, RE and respective left and right sections 56, 58 located above and behind the respective left and right ears LE, RE. The left and right side edge portions 36, 38 include a portion of left and right sections 56, 58.

A substantial part of the outer shell 12 is made of a first, relatively rigid, material, such as NYLON, polycarbonate materials, thermoplastics, or thermosetting resins, reinforced thermoplastics, or reinforced thermosetting resins, polyethylene, polypropylene or any other suitable material.

Moreover, at least a portion of the outer shell 12 is made of a second flexible material characterized by higher flexibility. Here most of the outer shell 12 is made of the first, relatively rigid, material and thus the protective properties of the helmet are maintained. However, where it is desirable, the second material provides regions of flexibility (see the regions of the outer shell 12 shown with diagonal lines). The regions of flexibility in the outer shell 12 need not to extend continuously. It is therefore possible for the outer shell 12 to include two-layered areas where a certain surface of the outer shell 12 has the first material and the other surface, the second material.

In a non-limiting embodiment, regions of flexibility are located along the edge 30 of the outer shell 12. As shown in FIGS. 3 to 8, the front edge portion 32, rear edge portion 34, left and right side edge portions 36, 38 (including parts of left and right sections 56, 58) and left and right projections 46, 48 are each regions of flexibility, made up of the second material. The reader will appreciate that this is just an example and that it is not necessary for the entire aforementioned edge portions to be made up of the second material. Alternatively, a region of flexibility can span upwards beyond an edge region. Regions of flexibility need not be disposed along the entire edge 30 or along the entire area of portions 32, 34, 36, 38 but can span only portions thereof.

Here, every portion of the outer shell 12 adjacent to the edge 30 is made of the second flexible material. Since the regions adjacent to the edge 30 are the regions most likely to come into contact with a portion of the head, having regions of flexibility thereabouts is particularly for comfort and injury avoidance. Furthermore, because the left and right projections 46, 48 are made of the second flexible material, that permits a certain bending of the left and right projections 46, 48. Thus, the outer shell 12 can deform in the left and right projections 46, 48 to accommodate different head/facial structures. It is not, however, necessary for the entire left and right projection 46, 48, to be made of the second flexible material. Indeed, left and right projections 46, 48 may optionally be made of both the first and second materials.

Additionally, other regions of flexibility, made of the second material may be present elsewhere in the outer shell 12. For example, a section 50 in the top, left and right portions 20, 26, 28 of helmet 10 may include the second flexible material. Here the outer shell 12 in the section 50 is made of the first material with the second material overmolded onto this first material.

In a non-limiting embodiment, the two materials making up the outer shell 12 are overmolded together. Advantageously, overmolding techniques provide a simple, cost-efficient and quick means of mass-producing outer shell 12.

In a non-limiting embodiment, the outer shell 12 is produced in a dual-injection shell mold that includes two cavities. A molding core closes with the first cavity and the first material of outer shell 12 is injected into the mold. When the core is pulled away, the first material has formed on the core the shape it is to assume. The core, with the first material is then inserted into the second cavity and the second material is injected for overmolding where appropriate. In a non-limiting embodiment two cores are used such that both cavities can be used at the same time. In this example, the two cavities are in one wall and the two cores are mounted on a platform in a way that they can both be inserted into the cavities at the same time. While the first cavity/core combination is molding the first material, the second cavity/core is overmolding the second material on a previously-molded layer of first material. When the cores and cavities are separated, the completed outer shell (the one that had been undergoing the overmolding step) is removed and the platform pivots such that the other, semi-completed, shell inserts into the second cavity. The first cavity receives the now-empty core. This, of course, is only one way of performing the overmolding and it is to be understood that any suitable molding techniques and technologies may be used.

The molding step described above, in the non-limiting embodiment illustrated here, would have to be performed twice: once for the front shell 16 and once for the rear shell 18. This is because in the example provided, the outer shell 12 is made of two separate pieces. It is to be understood that the shell 12, can be made of any number of pieces, including only one. Here, however, the front and rear shells 16, 18 would require different molds since they are not identical.

The first and second materials are selected based on a number of factors. For the first material, characteristics determining its ability to protect the head of the player from impact may be of interest. For the second material, one concern may be the physical feel of the material. Many other characteristics such as flexibility, tensile strength, hardness, density and cost may be considered in selecting the first and second materials however, in a non-limiting embodiment, they are also selected based on their suitability for overmolding. For example, the materials may be selected for their ability to adhere to one another. In a non-limiting example, the second material has a higher melting point such that it slightly melts the surface of the first material during overmolding. It is understood that the second material must have a melting point equal or higher. Preferably the melting points of the first and second materials will be similar and in a non-limiting embodiment, the melting points of the respective materials are within 75° C. of each other. Also preferably, the two materials are selected from the same family as materials from the same family tend to be more compatible (e.g. HDPE and MDPE; HDPE and HPDE plus a polyolefin elastomer; hard TPE and soft TPE).

In a non-limiting example, the first material has a flexural modulus defined by the American Society for Testing and Materials (ASTM) D790 standard as between 700 MPa and 1500 MPa. The first material may further have a hardness defined by ASTM D2240 as 60 to 75 SHORE D.

In a non-limiting example, the second material has a flexural modulus defined by the ASTM D790 standard as between 200 MPa and 650 MPa. The second material may further have a hardness defined by the ASTM D2240 standard as 40 to 55 SHORE D.

Therefore, the second material is more flexible, and may be less hard than the first material and thus have a "softer feel" than the first material. As mentioned above, the second material may also have a higher melting point than the first. In a non-limiting example, the first material may be made of high density polyethylene such as HDPE 2907 while the second material may be made of medium density polyethylene such as MDPE 50. In another non-limiting example, the first material may be made of a thermoplastic elastomer such as PEBAX™ 7233 while the second material may be made of a thermoplastic elastomer such as PEBAX™ 5533. In yet another non-limiting example, the first material may be polypropylene 7633U T14 while the second material may be polypropylene 7633U.

Other possible combination: HDPE 2907 and HPDE 2907 (50 to 70%) plus a polyolefin elastomer (30% to 50%), It is to be understood that the above-described embodiments were provided to illustrate, not to limit, the invention, many other possible variants being readily conceivable by one skilled in the art.

While in the examples provided, the outer shell 12 is composed of only two materials, it is to be understood that any number of materials may be used with any particular molding or connecting technique. For example, the outer shell 12 may comprise three different materials put together with two overmolding steps. Alternatively, the outer shell 12 may comprise the above-described shell to which has been added additional items or material by, for example, mechanical fastening means.

In describing the embodiments, specific terminology is resorted to for the sake of clarity but the invention is not intended to be limited to the specific terms so selected, and it is understood that each specific term comprises all equivalents. The above description of the embodiments should not be interpreted in a limiting manner since other variations, modifications and refinements are possible within the spirit and scope of the present invention. The scope of the invention is defined in the appended claims and their equivalents.

The invention claimed is:

1. A hockey helmet for receiving a head of a player, the head having a crown region (CR), left and right side regions (LS, RS), a top region (TR), left and right ears (LE, RE), a back region (BR), an occipital region (OC), said helmet comprising an outer shell made of first and second plastic materials having respective first and second flexibilities, said outer shell comprising:

(a) a front outer shell having a front portion for at least partially facing the crown region (CR) of the head, a top portion for at least partially facing, the top region (TR) of the head, and left and right portions for at least partially facing the left and right side regions (LS, RS) of the head, said left and right portions comprising respective left and right protections extending downwardly in front of the respective left and right ears (LE, RE); and (b) a rear outer shell having a top portion for at least partially facing the top region (TR) of the head, a back portion for at least partially facing the back region (BR) of the head, an occipital portion for at least partially facing the occipital region (OC) of the head, and left and right portions for at least partially facing the left and right side regions (LS, RS) of the head, said left and right portions comprising respective left and right sections located behind the respective left and right ears (LE, RE);

wherein one of said left and right sections, said left and right projections and said front portion is partially made of said second plastic material overmolded onto said first plastic material while remaining of said front and rear outer shells is made of said first material only, and wherein said second flexibility is greater from said first flexibility.

2. A hockey helmet as defined in claim 1, wherein said outer shell further comprises an edge in said front outer shell and wherein said edge is entirely made of said second plastic material.

3. A hockey helmet as defined in claim 2, wherein at least a portion of said top portion and said back portion of said rear outer shell is made of said second plastic material overmolded onto said first plastic material.

4. A hockey helmet as defined in claim 1, wherein said outer shell further comprises an edge in said front portion and in said left and right projections of said front outer shell and in said left and right sections and said occipital portion of said rear outer shell and wherein at least a portion of said edge is entirely made of said second plastic material.

5. A hockey helmet as defined in claim 1, wherein said occipital portion and left and right sections are partially made of said second plastic material overmolded onto said first plastic material.

6. A hockey helmet as defined in claim 1, wherein said front portion comprises an edge entirely made of said second plastic material.

7. A hockey helmet as defined in claim 1, wherein said left and right projections are entirely made of said second plastic material overmolded onto said first plastic material such that said left and right projections are adapted to bend.

8. A hockey helmet as defined in claim 7, wherein said top portion of said rear outer shell is partially made of said second plastic material overmolded onto said first plastic material.

9. A hockey helmet as defined in claim 1, wherein said second plastic material has a higher melting point than said first plastic material.

10. A hockey helmet as defined in claim 9, wherein the difference in the melting points of said first and second plastic materials is less than 75° C.

11. A hockey helmet as defined in claim 1, wherein said first plastic material has a flexural modulus between 700 MPa and 1500 MPa and said second plastic material has a flexural modulus between 200 MPa and 650 MPa.

12. A hockey helmet as defined in claim 1, wherein said first plastic material has a hardness between 60 to 75 SHORE D and said second plastic material has a hardness between 40 to 55 SHORE D.

13. A hockey helmet as defined in claim 1, wherein said first plastic material is polyethylene 2907 and said second plastic material is polyethylene MD50.

14. A hockey helmet as defined in claim 1, wherein said first plastic material is PEEAX™7233 and said second material is PEEAX™5533.

15. A hockey helmet as defined in claim 1, wherein said first material is polypropylene 76331U T14 and said second plastic material is polypropylene 7633U.

16. A hockey helmet as defined in claim 1, wherein said first plastic material is HPDE 2907 plus a polyolefin elastomer.

17. A hockey helmet as defined in claim 1, wherein said left and right projections and said left and right sections are entirely made of said second plastic material overmolded onto said first plastic material such that said left and right projections and sections are adapted to bend.

18. A hockey helmet as defined in claim 4, wherein said edge in said front portion, said left and right projections and said left and right sections is entirely made of said second plastic material.

19. A hockey helmet as defined in claim 1, wherein said occipital portion comprises an edge entirely made of said second plastic material.

20. A hockey helmet as defined in claim 1, wherein said front and rear outer shells are movable relative to one another for adjusting the helmet in the lengthwise direction.

21. A hockey helmet as defined in claim 1 further comprising front, top, rear, left, right and occipital inner pads affixed to respective inner surfaces of said outer shell.

22. A hockey helmet as defined in claim 21, wherein each inner pad is made of expanded polypropylene or expanded polyethylene.

23. A helmet as defined in claim 22, further comprising a plurality of comfort liners, each comfort liner being affixed to an inner surface of a corresponding inner pad.

24. A hockey helmet as defined in claim 1, further comprising left and right ear covers for protecting the respective left and right ears (LE, RE).

25. A hockey helmet for receiving a head of a player, the head having a crown region (CR), left and right side regions (LS, RS), a top region (TR), left and right ears (LE, RE), a back region (BR), an occipital region (OC), said helmet comprising an outer shell made of first and second plastic materials having respective first and second flexibilities, said outer shell comprising:

(a) a front outer shell having a front portion for at least partially facing the crown region (CR) of the head, a top portion for at least partially facing the top region (TR) of the head, and left and right portions for at least partially facing the left and right side regions (LS, RS) of the head, said left and right portions comprising respective left and right projections extending downwardly in front of the respective left and right ears (LE, RE); and (b) a rear outer shell having a top portion for at least partially facing the top region (TR) of the head, a back portion for at least partially facing the back region of the head, an occipital portion for at least partially facing the occipital region (OC) of the head, and left and right portions for at least partially facing the left and right side regions (LS, RS) of the head, said left and right portions comprising respective left and right sections located behind the respective left and right ears (LE, RE);

wherein said left and right projections and said left and right sections are partially made of said second plastic material overmolded onto said first plastic material while remaining of said front and rear outer shells is made of said first material only, and wherein said second flexibility is greater from said first flexibility.

26. A hockey helmet as defined in claim 25, wherein said left and right projections are entirely made of said second plastic material overmolded onto said first plastic material such that said left and right projections are adapted to bend.

27. A hockey helmet as defined in claim 25, wherein said occipital portion comprises an edge entirely made of said second plastic material.

28. A hockey helmet as defined in claim 25, wherein said front portion comprises an edge entirely made of said second plastic material.

29. A hockey helmet as defined in claim 25, wherein said left and right sections are entirely made of said second plastic material overmolded onto said first plastic material such that said left and right sections are adapted to bend.

30. A hockey helmet as defined in claim 25, wherein said top portion of said outer rear shell is partially made of said second plastic material overmolded onto said first plastic material.

31. A hockey helmet as defined in claim 25, wherein said second material has a higher melting point than said first material.

32. A hockey helmet as defined in claim 31, wherein the difference in the melting points of said first and second plastic materials is less than 75° C.

33. A hockey helmet as defined in claim 25, wherein said first plastic material has a flexural modulus between 700 MPa and 1500 MPa and said second plastic material has a flexural modulus between 200 MPa and 650 MPa.

34. A hockey helmet as defined in claim 25, wherein said first plastic material has a hardness between 60 to 75 SHORE D and said second plastic material has a hardness between 40 to 55 SHORE D.

35. A hockey helmet as defined in claim 25, wherein said first plastic material is polyethylene 2907 and said second plastic material is polyethylene MD50.

36. A hockey helmet as defined in claim 25, wherein said first plastic material is PEBAX™7233 and said second plastic material is PEBAX™5533.

37. A hockey helmet as defined in claim 25, wherein said first plastic material is polypropylene 7633U T14 and said second plastic material is polypropylene 7633U.

38. A hockey helmet as defined in claim 25, wherein said first plastic material is HPDE 2907 plus a polyolefin elastomer.

39. A hockey helmet as defined in claim 25, wherein said front and rear outer shells are movable relative to one another for adjusting the helmet in the lengthwise direction.

40. A hockey helmet as defined in claim 27 further comprising front, top, rear, left, right and occipital inner pads affixed to respective inner surfaces of said outer shell.

41. A hockey helmet as defined in claim 25, wherein said left and right projections comprise left and right edges entirely made of said second plastic material.

42. A helmet as defined in claim 25, wherein said left and right sections comprise left and right edges entirely made of said second plastic material.

43. A hockey helmet as defined in claim 25, further comprising left and right ear covers for protecting the respective left and right ears (LE, RE).

44. A hockey helmet for receiving a head of a player, the head having a crown region (CR), left and right side regions (LS, RS), a top region (TR), left and right ears (LE, RE), a back region (BR), an occipital region (OC), said helmet comprising an outer shell made of first and second plastic materials having respective first and second flexibilities, said outer shell comprising:

(a) a front outer shell having a front portion for at least partially facing the crown region (CR) of the head, a top portions for at least partially facing the top region (TR) of the head, and left and right portions for at least partially facing the left and right side regions (LS, RS) of the head, said left and right portions comprising respective left and right projections extending downwardly in front of the respective left and right ears (LE, RE), wherein said front portion has a front edge; and (b) a rear outer shell having a top portion for at least partially facing the top region (TR) of the head, a back portion for at least partially facing the back region (BR) of the head, an occipital portion for at least partially facing the occipital region (OC) of the head, and left and right portions for at least partially facing the left and right side regions (LS, RS) of the head, said left and right portions comprising respective left and right sections located behind the respective left and right ears (LE, RE);

wherein one of said front edge, said left and right projections, and said left and right sections is partially made of said second plastic material overmolded onto said first plastic material while remaining of said front and rear outer shells is made of said first material only, and wherein said second flexibility is greater from said first flexibility.

45. A hockey helmet as defined in claim 44, wherein said front edge is entirely made of said second plastic material and said left and right projections comprise left and right edges entirely made of said second plastic material.

46. A hockey helmet as defined in claim 44, wherein said left and right projections are entirely made of said second plastic material overmolded onto said first plastic material such that said left and right projections are adapted to bend.

47. A hockey helmet as defined in claim 44, wherein said occipital portion comprises edge entirely made of said second plastic material.

48. A hockey helmet as defined in claim 44, wherein said left and right sections comprise left and right edges entirely made of said second plastic material.

49. A hockey helmet as defined in claim 44, further comprising left and right ear covers for protecting the respective left and right ears (LE, RE).

* * * * *

UNITED STATES PATENT AND TRADEMARK OFFICE

CERTIFICATE OF CORRECTION

PATENT NO. : 8,191,179 B2
APPLICATION NO. : 12/020057
DATED : June 5, 2012
INVENTOR(S) : Jacques Durocher et al.

It is certified that error appears in the above-identified patent and that said Letters Patent is hereby corrected as shown below:

- Col. 7, Claim 1, line 26, the "," between "facing" and "the" should be removed;
- Col. 7, Claim 1, (a), line 30, "protections" should read "projections";
- Col. 8, Claim 14, "PEEAX" should read "PEBAX" both occurrences;
- Col. 9, Claim 25, line 9, "(BR)" is missing after "back region";
- Col. 10, Claim 44, (a), line 25, "portions" should read "portion".

Signed and Sealed this
Seventh Day of August, 2012

David J. Kappos

David J. Kappos
*Director of the United States Patent and Trademark Office*